US006089996A

United States Patent [19]

Hsu

[11] Patent Number: 6,089,996

[45] Date of Patent: Jul. 18, 2000

[54] RACKET HANDLE HAVING A SHOCK ABSORBING END CAP

[76] Inventor: Young-Chen Hsu, No. 121, Section 1, Shen Lin Rd., Taya Hsiang, Taichung Hsien, Taiwan

[21] Appl. No.: 09/296,428

[22] Filed: Apr. 23, 1999

[51] Int. Cl.[7] ..... A63B 49/08

[52] U.S. Cl. ..... 473/523; 473/549

[58] Field of Search ..... 473/549, 551, 473/520, 521, 523, 298, 300

[56] References Cited

U.S. PATENT DOCUMENTS

| | | | |
|---|---|---|---|
| 5,322,280 | 6/1994 | Wu | 473/523 |
| 5,362,046 | 11/1994 | Sims | 473/523 X |
| 5,605,327 | 2/1997 | McCutchen | 473/523 |
| 5,964,672 | 10/1999 | Bianchi | 473/521 |
| 6,007,439 | 12/1999 | Mackay, Jr. | 473/520 |

FOREIGN PATENT DOCUMENTS

| | | | |
|---|---|---|---|
| 315423 | 5/1989 | European Pat. Off. | 473/FOR 183 |
| 323485 | 1/1930 | United Kingdom | 473/FOR 183 |

*Primary Examiner*—Raleigh W. Chiu
*Attorney, Agent, or Firm*—Rosenberg, Klein & Lee

[57] ABSTRACT

A handle for a racket includes a tubular handle with an end cap mounted to the distal end thereof. The end cap has a bottom board and a swinging device is connected to the bottom board and the swinging device is swingable in the handle. The swinging device includes a cup-like flexible frame and a weight which is retained in the tubular frame so that the flexible frame swings in the tubular handle to absorb the shocks.

5 Claims, 5 Drawing Sheets

RACKET HANDLE HAVING A SHOCK ABSORBING END CAP

FIELD OF THE INVENTION

The present invention relates to a handle of a racket wherein an end cap is mounted to the distal end of the handle and a swinging means is connected to the end cap and received in the handle so as to absorb shocks transferred from the racket.

BACKGROUND OF THE INVENTION

As illustrated in FIG. 1, a tennis racket includes a head 1, a shaft 11 extending from the head 1 and a handle 2 connected to the shaft 11. The severe shocks due to the impact when a ball hitting the racket will be resisted by the hand so as to reduce the shaking of the racket. The shaking of the racket is illustrated in FIG. 3 and will be borne by the player's hand so that the player's hand feel uncomfortable even feel painful if the impact is big enough. Referring to FIG. 2, the handle 2 has an end cap 3 mounted thereto and the end cap 3 is tapered in its outside. A flange 31 extends inwardly from the inside of the end cap 3 and a board comprising a body 5 and an engaging plate 51 is engaged with the end cap 3. When a shock is transferred from the racket to the handle 4, the player's hand has to hold the handle tightly to reduce the shaking. Therefore, everytime the ball hits the racket, the player consumes his/her effort to reduce the shaking of the racket.

The present invention intends to provide a handle which has a swinging means connected to the end cap and the swinging means is received in the handle so that the shocks transferred from the racket will be absorbed by the swinging means and the shaking of the handle is therefore reduced. The handle of the present invention effectively reduce the shaking of the handle and resolves the shortcomings found in the conventional tennis racket handle.

SUMMARY OF THE INVENTION

In accordance with one aspect of the present invention, a handle for a racket is provided and comprises a tubular handle with an end cap mounted to the distal end thereof. The end cap has a bottom board and a swinging means is connected to the bottom board. The swinging means includes a flexible frame and a weight is retained in the tubular frame so that the flexible frame is swingable in the tubular handle.

The primary object of the present invention is to provide a handle of a racket wherein a swinging means is swingable in the handle so as to absorb shaking energy when a ball impacts the racket.

Further objects, advantages, and features of the present invention will become apparent from the following detailed description with appropriate reference to the accompanying drawings.

DETAILED DESCRIPTION OF THE PREFERRED EMBODIMENTS

Figure 1:
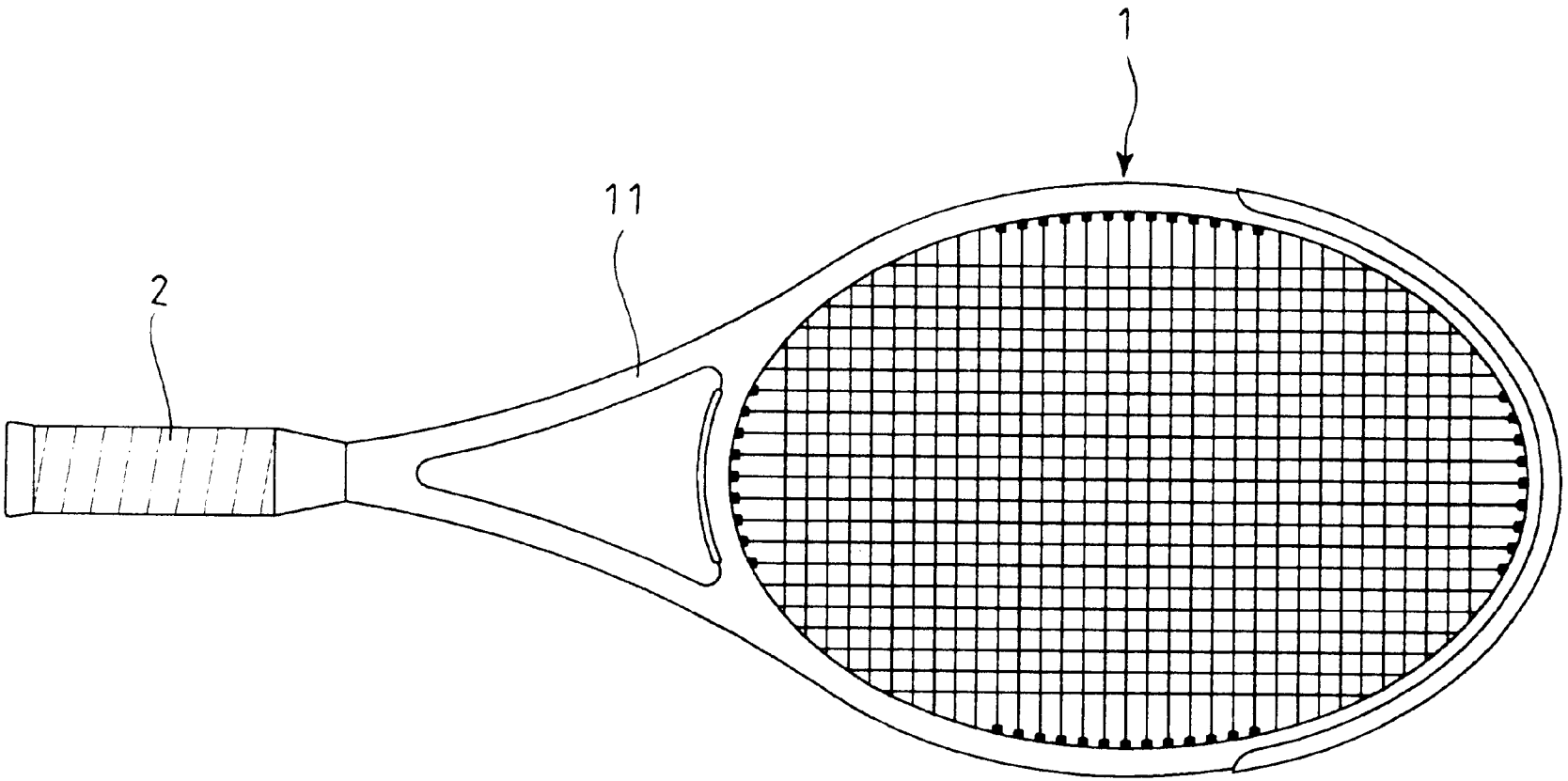
FIG.1 PRIOR ART
FIG. 1 is a perspective view of a conventional racket.
Figure 2:
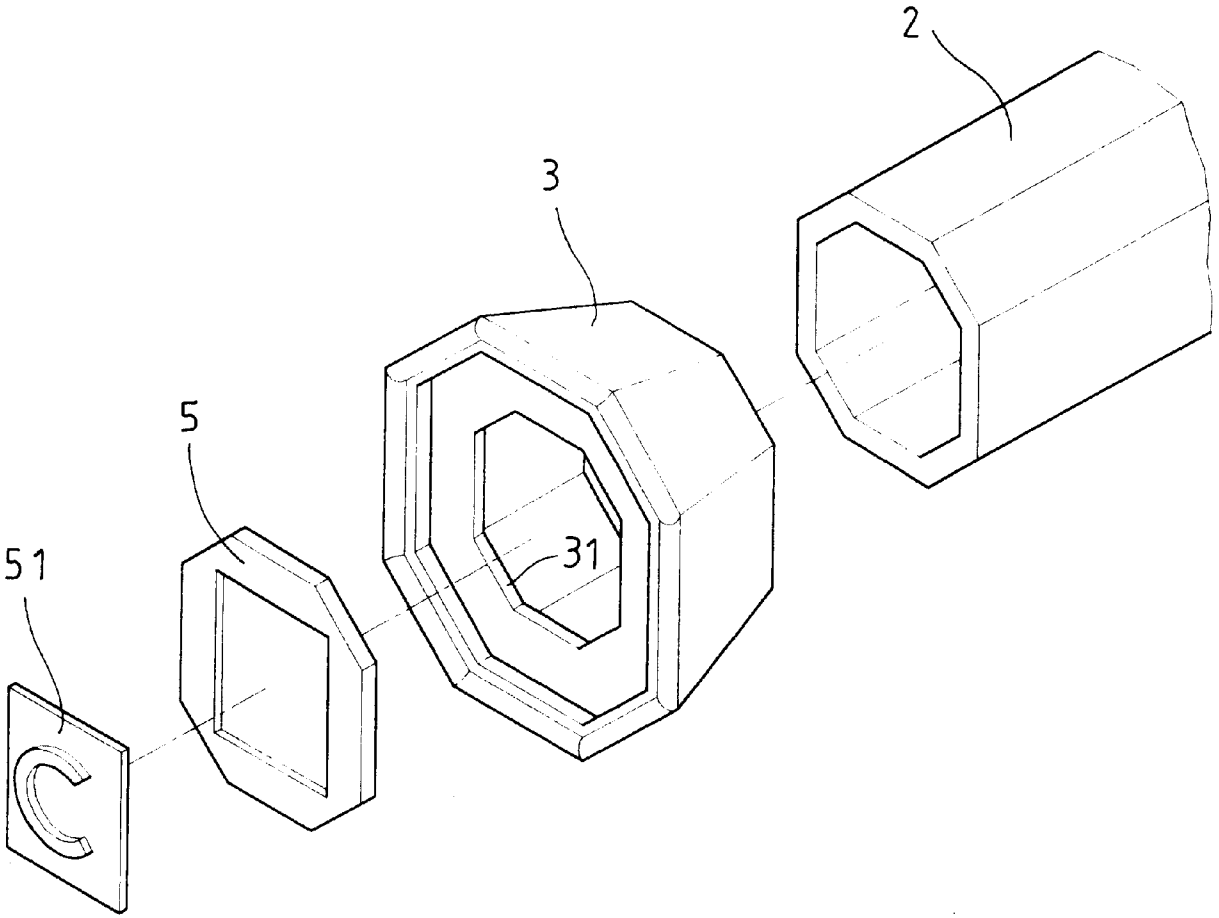
FIG.2 PRIOR ART
FIG. 2 is an exploded view of the handle and the end cap of the conventional racket.
Figure 3:
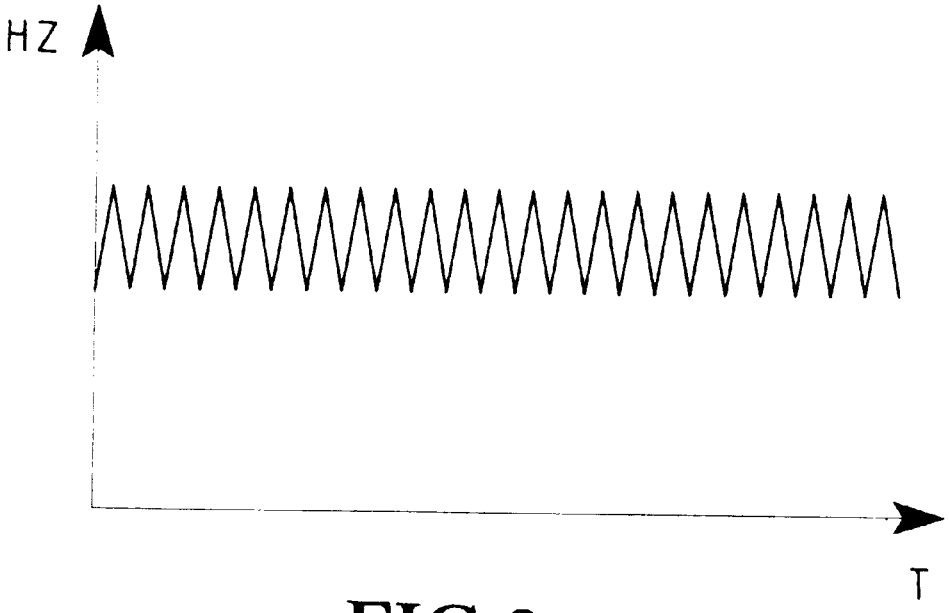
FIG.3 PRIOR ART
FIG. 3 is an illustrative view to illustrate the relationship between the shaking frequency of the conventional racket handle and time.
Figure 4:
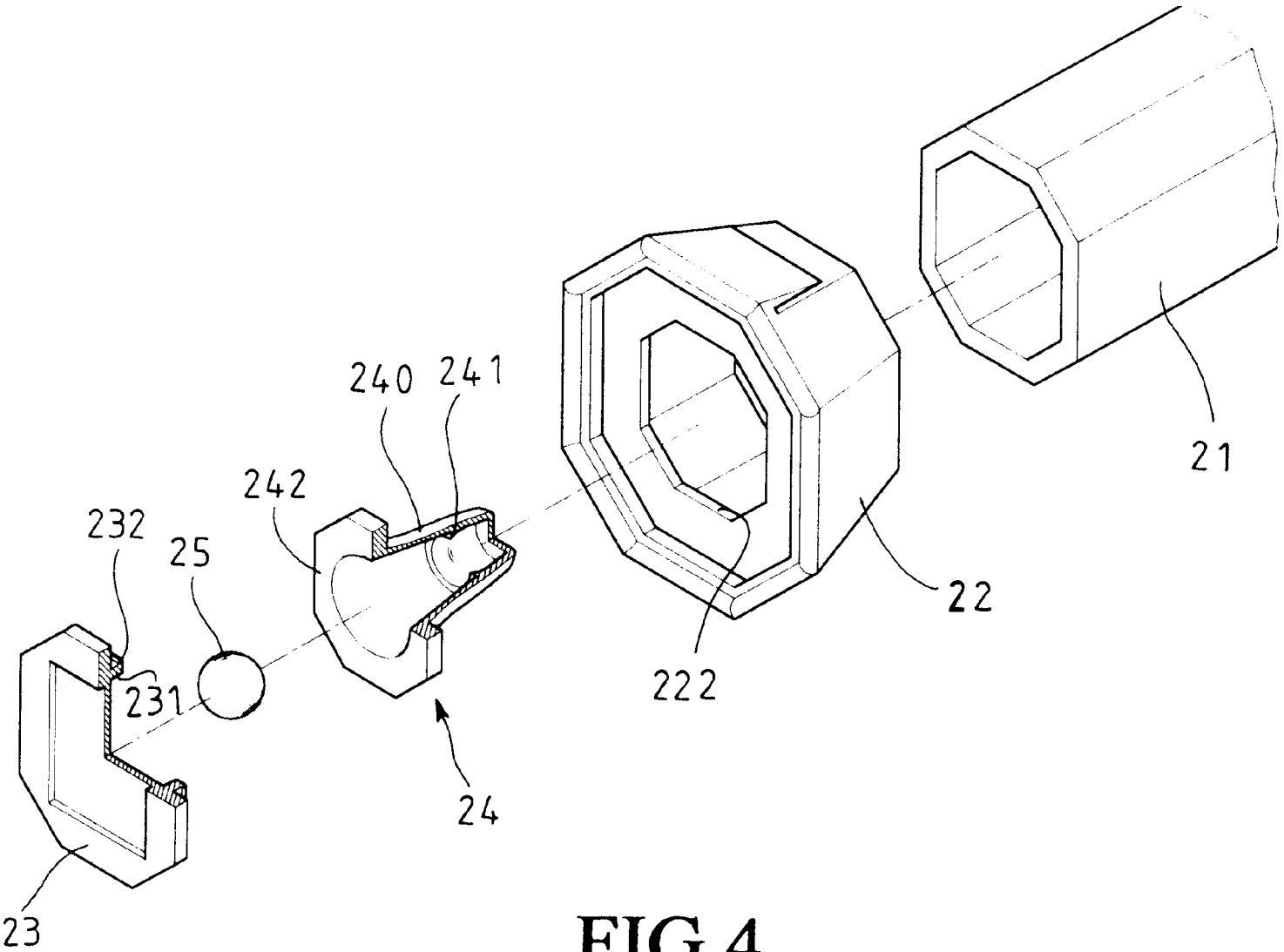
FIG. 4 is an exploded view of the handle and end cap in accordance with the present invention.

Referring to FIGS. 2 and 4, the handle for a racket in accordance with the present invention comprises a tubular handle 21 and an end cap 22 is mounted to the distal end of the tubular handle 21. The end cap 22 has a bottom board 23 connected thereto wherein the end cap 22 has an annular flange 222 extending radially inward from the inside thereof so as to define a central hole enclosed by the annular flange 222. The bottom board 23 has an annular lip 231 extending from one of two sides thereof so as to extend through the central hole. The annular lip has an annular hook flange 232 extending therefrom so as to engaged with the annular flange 222.

A swinging means is connected to the bottom board 23 and includes a flexible frame 24 and a weight 25 which is retained in the tubular frame 24. The flexible frame 24 is a cup-like member and made of flexible material such as rubber or PVC, and has a bottom end and an open end. A positioning flange 241 extends radially inward from the inside of the flexible frame 24. The open end of the flexible frame 24 has an annular flange 242 extending radially outward therefrom so that the annular flange 242 is securely engaged with the inside of the annular lip 231. A weight 25 is retained between the positioning flange 241 and the bottom end, wherein the weight of the weight 25 is preferable below 6 grams. Therefore, the flexible frame 24 is swingable in the tubular handle 21.

Figure 7:
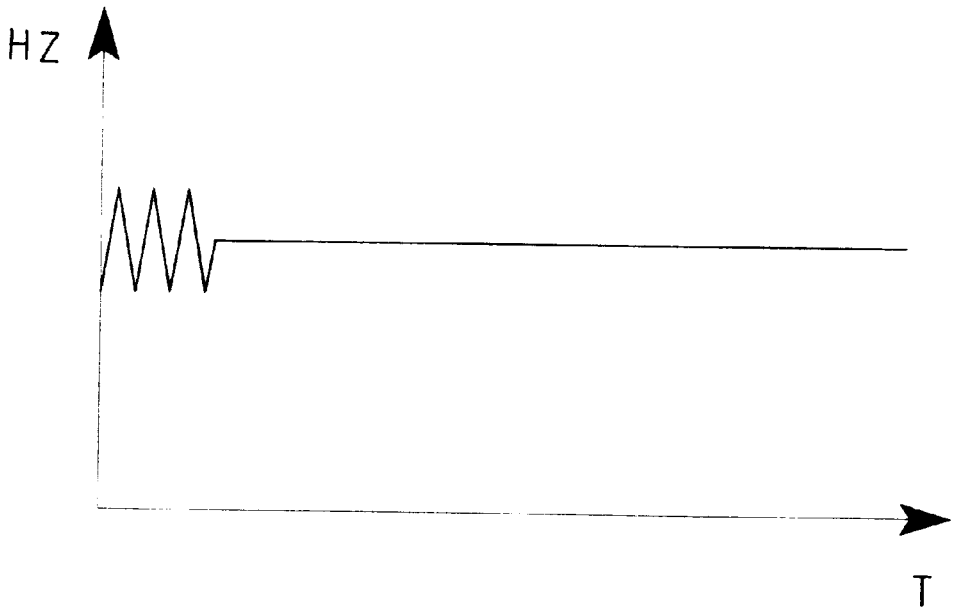
FIG. 7 is an illustrative view to illustrate the relationship between the shaking frequency of the handle in accordance with the present invention and time.

Referring to FIG. 7, when shocks are transferred to the racket to the tubular handle 21, the flexible frame 24 together with the weight 25 swings to abort the shaking energy and the shaking of the tubular handle 21 is therefore reduced.

Figure 5:
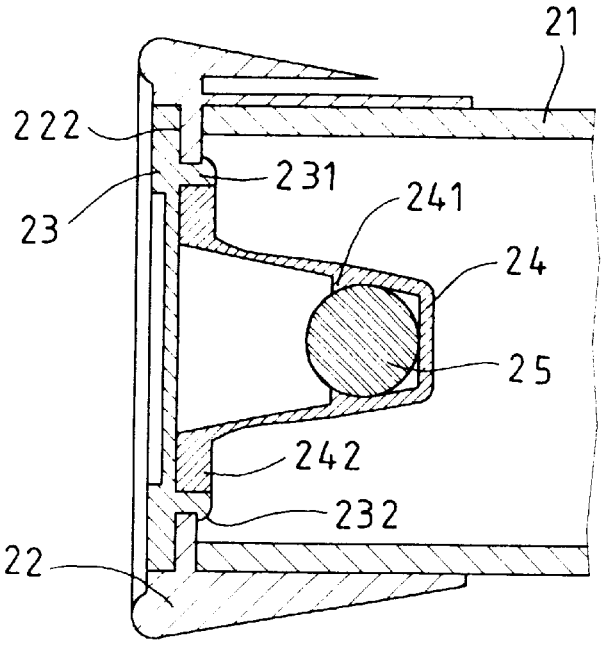
FIG. 5 is a side elevational view, partly in section, of the first embodiment of the handle and the swinging means in accordance with the present invention.
Figure 6:
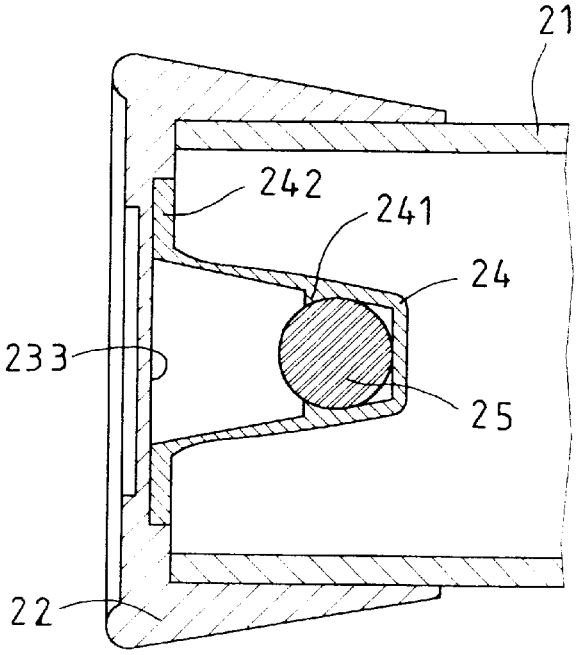
FIG. 6 is a side elevational view, partly in section, of the second embodiment of the handle and the swinging means in accordance with the present invention.

FIG. 6 shows another embodiment of the present invention, wherein the bottom board 23 has no annular lip 231 as shown in FIG. 5 and has a recess 233 defined in one of two sides thereof. The annular flange 242 extending from the open end of the flexible frame 24 is securely engaged with the recess 233.

The invention is not limited to the above embodiment but various modification thereof may be made. It will be understood by those skilled in the art that various changes in form and detail may made without departing from the scope and spirit of the present invention.

What is claimed is:

1. A handle for a racket, comprising:

a tubular handle and an end cap mounted to the distal end thereof, said end cap having a bottom board, and a swinging means connected to said bottom board and including a flexible frame, a weight retained in said flexible frame, said flexible frame being swingable in said tubular handle.

2. The handle as claimed in claim 1, wherein said end cap has an annular flange extending radially inward from the inside thereof so as to define a central hole enclosed by said annular flange, said bottom board having an annular lip extending from one of two sides thereof so as to extend through said central hole, said annular lip having an annular hook flange extending therefrom so as to engaged with the annular flange.

3. The handle as claimed in claim 1, wherein said flexible frame is a cup-like member having a bottom end and an open end, a positioning flange extending radially inward from the inside of said flexible frame, a weight retained between said positioning flange and said bottom end.

4. The handle as claimed in claim 1, wherein said open end of said flexible frame has an annular flange extending radially outward therefrom, said annular flange securely engaged with the inside of said annular lip.

5. The handle as claimed in claim 3, wherein said bottom board has a recess defined in one of two sides thereof and said open end of said flexible frame is securely engaged with said recess.

* * * * *